US005399934A

United States Patent [19]

Zegers

[11] Patent Number: 5,399,934

[45] Date of Patent: Mar. 21, 1995

[54] DISPLAY DEVICE COMPRISING COMPENSATION COILS

[75] Inventor: Antonius P. F. Zegers, Eindhoven, Netherlands

[73] Assignee: U.S. Philips Corporation, New York, N.Y.

[21] Appl. No.: 881,908

[22] Filed: May 12, 1992

[30] Foreign Application Priority Data

Jun. 25, 1991 [EP] European Pat. Off. ..... 91201612

[51] Int. Cl.[6] ..... H01J 29/98

[52] U.S. Cl. ..... 313/440; 313/431

[58] Field of Search ..... 313/440, 413, 431

[56] References Cited

U.S. PATENT DOCUMENTS 4,857,805 8/1989 Bosch et al. ..... 313/440 X 4,992,697 2/1991 Penninga et al. ..... 313/440

FOREIGN PATENT DOCUMENTS 0327161 1/1989 European Pat. Off. .

2217959 11/1989 United Kingdom .

2223649 4/1990 United Kingdom .

*Primary Examiner*—Sandra L. O'Shea

*Attorney, Agent, or Firm*—Robert J. Kraus

[57] ABSTRACT

A display device comprising a cathode ray robe having a deflection unit with elongated compensation coils for compensating the stray field of the deflection unit next to the display device. The distance between the coils is preferably at least 0.7 times the dimension of the display window in the line deflection direction, and the length/width ratio of the coils is at least 3:1.

10 Claims, 2 Drawing Sheets

DISPLAY DEVICE COMPRISING COMPENSATION COILS

BACKGROUND OF THE INVENTION

The invention relates to a display device comprising a cathode ray tube having an electron gun, a display window and a deflection coil system for deflecting one or more electron beams across the display window in a field deflection direction and a line deflection direction, and comprising compensation means for compensating the stray field of the deflection coil system.

Such a display device is known from United Kingdom Patent Specification 2 217 959.

Such display devices axe used in, inter alia, television receivers and computer monitors.

In such display devices, one or more electron beams axe deflected, in operation, by a deflection coil system. To this end, the deflection coil system generates, in operation, an electromagnetic deflection field. In operation, however, the deflection coil system also generates electromagnetic stray fields. Such stray fields can adversely affect the picture display in closely spaced display devices. The strength of the stray fields can be reduced by providing the display device with compensation means for generating electromagnetic fields which, at some distance from the display device, are in opposition to and of approximately equal strength as the stray field. It is an object of the invention to provide a display device in which the above negative interference can be reduced in a simple and effective manner.

SUMMARY OF THE INVENTION

For this purpose, a display device of the type described in the opening paragraph is characterized in that the compensation means comprise two coils which extend on either side of a plane of symmetry of the display window, which plane extends parallel to the field deflection direction, and in that the coils have an elongated shape such that the dimension of the coils in the field deflection direction is more than thrice the dimension of the coils in a direction transversely to the field deflection direction and transversely to the line deflection direction.

Coils having such an elongated shape very effectively reduce the negative effect of stray fields in display devices arranged next to the display device according to the invention. If the above-mentioned ratio is smaller than 3:1, a relatively high magnetic energy must be generated in the compensating field to obtain an effective compensation. By virtue of the elongated shape of the coils, the compensating field is concentrated in a relatively small spatial area in a favourable and simple manner.

Preferably, the interspace between the coils is more than approximately 0.7 times the dimension of the display window in the line deflection direction.

A smaller interspace between the coils adversely affects the display device's own deflection field.

Preferably, the dimension of the coils in the field deflection direction is more than approximately 0.5 times the dimension of the display window in the field deflection direction.

In a further embodiment of the display device according to the invention, a display device is provided in which the negative effect of stray fields on display devices located below and/or above the display device according to the invention is very effectively reduced.

To this end, an embodiment of the display device according to the invention is characterized in that the compensation means comprise two solenoid coils having a magnetic core, which coils extend on either side of a plane of symmetry of the display window, which plane extends parallel to the line deflection direction, the longitudinal direction of the solenoid coils being approximately parallel to the line deflection direction. The interspace between the solenoid coils is preferably more than 0.5 times the dimension of the display window in the field deflection direction.

The length of the magnetic cores ranges preferably between 0.4 and 0.8 times the dimension of the display window in the line deflection direction. In operation, the compensating field generated by the solenoid coils has a spatial shape such that relatively little magnetic energy has to be generated in the compensating field to obtain an effective compensation.

Within the framework of the invention, line deflection is to be understood to mean deflection at a high frequency, and field deflection is to be understood to mean deflection at a low frequency.

BRIEF DESCRIPTION OF THE DRAWING

The invention will be explained in greater detail by means of exemplary embodiments of the display device according to the invention and with reference to the accompanying drawing figures, in which.

The Figures are not drawn to scale. In general, corresponding components in the Figures bear the same reference numerals.

DESCRIPTION OF THE PREFERRED EMBODIMENTS

Figure 1:
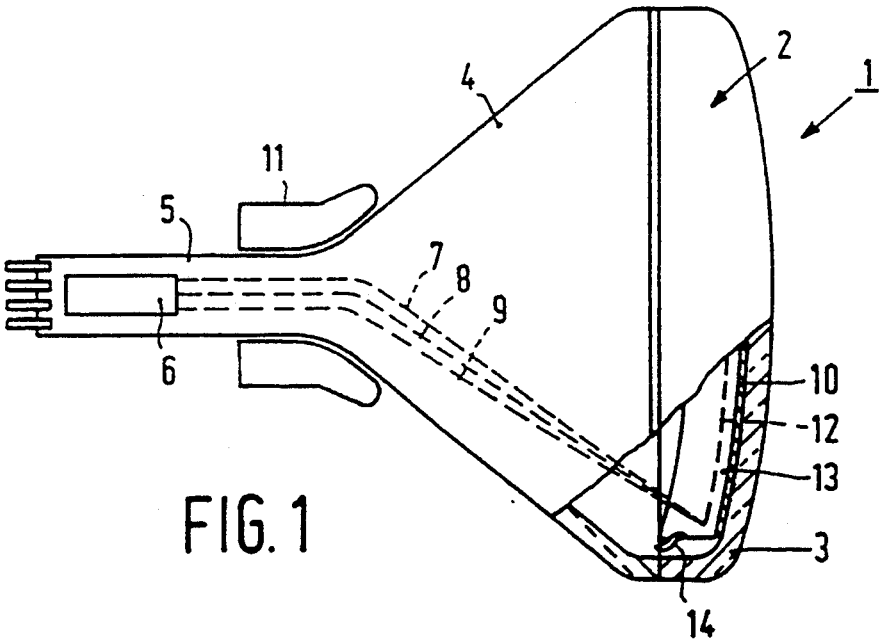
FIG. 1 is a longitudinal cross-sectional view of a display device according to the invention.

FIG. 1 is a longitudinal cross-sectional view of a display device according to the invention.

A display device, in this example color display device 1, comprises an evacuated envelope 2 which consists of a display window 3, a cone portion 4 and a neck 5. In the neck 5 there is provided an electron gun 6 for generating three electron beams 7, 8 and 9 which extend in one plane, the in-line plane, which in this case is the plane of the drawing. A display screen 10 is situated on the inside of the display window. The display screen 10 comprises a large number of phosphor elements luminescing in red, green and blue. On their way to the display screen 10, the electron beams 7, 8 and 9 are deflected across the display screen 9 by means of a system of deflection coils 11 and pass through a color selection electrode 12 which is arranged in front of the display window 3 and which comprises a thin plate having apertures 13. The color selection electrode is suspended in the display window by means of suspension means 14. The three electron beams 7, 8 and 9 pass through the apertures 13 of the color selection electrode at a small angle with each other and, hence, each electron beam impinges on phosphor elements of only one color. The plane in which the undeflected electron beams are situated is in this example parallel to the line deflection direction.

A problem which occurs consists in that the stray field of the field deflection coils adversely affects the picture display of nearby display devices. When two display devices are arranged at a relatively short distance from each other, for example next to each other, the stray field of one display device interferes with the deflection field of the other display device. This phenomenon occurs in particular when the display devices are provided with toroid field deflection coils. The stray field generated by a toroid coil has a substantial infuence on the deflection in nearby display devices.

Figure 2A:
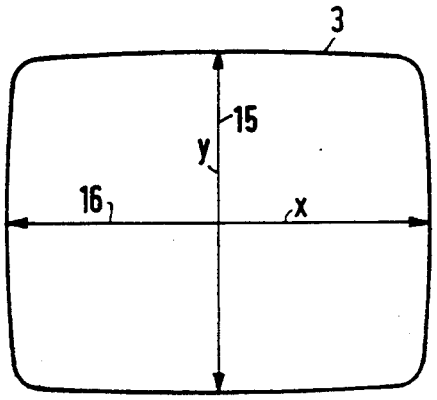
FIG. 2*a* is an elevational view of a display window.
Figure 2B:
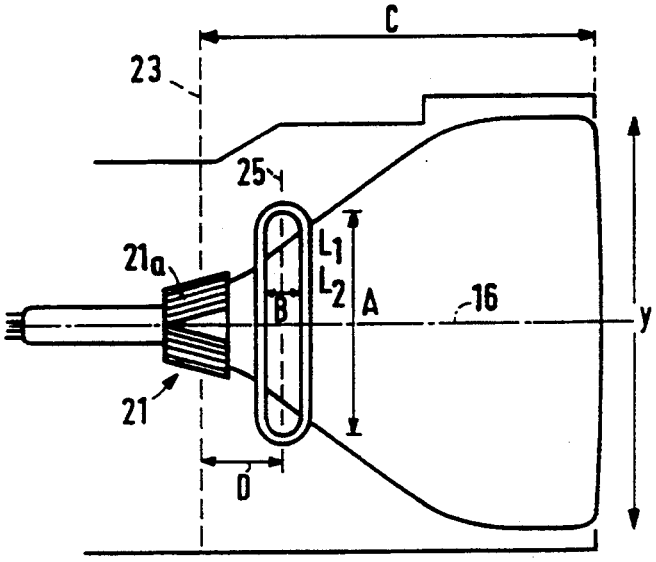
FIG. 2*b* is a side view of a display device according to the invention.

FIG. 2*a* is an elevational view of the display window 3. In this example, the cathode ray tube has a display window whose dimension is approximately 51 cm, measured diagonally across the display window. In this example, the line deflection direction is horizontal and the field deflection direction is vertical. The dimension of the display window in the line deflection direction (X-direction) is approximately 40 cm and the dimension in the field deflection direction (Y-direction) is approximately 30 cm. The plane of symmetry 15 of the display window 3, which extends parallel to the field deflection direction, and the plane of symmetry 16 of the display window 3, which extends parallel to the line deflection direction, are indicated. FIG. 2*b* is a side view of a display device according to the invention. The display device comprises a deflection system 21 for deflecting the electron beams in the field deflection direction which extends transversely to the plane of symmetry 16. The line deflection direction extends transversely to the field deflection direction and parallel to the display screen. In this example, the deflection system 21 comprises a toroid-type of coil 21*a*. Such a coil comprises a toroid core on which a coil is wound. The display device comprises a coil system of two coils $L_1$ and $L_2$ which extend on either side of the plane of symmetry 15 of the display window and parallel to the field deflection direction. In operation, the coils $L_1$ and $L_2$ generate a substantially laterally directed compensation field on either side of the display device, i.e. the compensation field is oriented in a direction approximately parallel to the line deflection direction. The coils exhibit an elongated, in this example rectangular, shape, with a length/width ratio in excess of 3:1. In this example, the dimension A of the coils $L_1$ and $L_2$ in a direction parallel to the field deflection direction is 17.5 cm, the dimension B of the coils $L_1$ and $L_2$ in a direction transversely to the field deflection direction and transversely to the line deflection direction is 3.0 cm, so that in this example the ratio A:B is approximately 6:1. In operation, such elongated coils generate a compensating field which is concentrated in a relatively small elongated area. If the length/width ratio is smaller than 3:1, the compensating magnetic field extends over a relatively large spatial area and, hence, relatively much magnetic energy must be generated in the compensating magnetic field. The dimension A of the coils $L_1$ and $L_2$ is preferably more than 0.5 times the dimension of the display window in the field deflection direction. If the dimension A is less than 0.5 times the dimension of the display window in the field deflection direction, an effective compensation of the stray field interfering with electron beams deflected towards the comers in a nearby display device is difficult to achieve. In this example, the dimension of A is 0.57 times the dimension of the display window in the field deflection direction. The distance G between the coils is preferably at least approximately 0.7 times the dimension of the display window in the line deflection direction. A closer spacing of the coils $L_1$ and $L_2$ adversely affects the deflection of the electron beams 7, 8 and 9 brought about by the deflection coil system 21. In this example, the distance G between the coils $L_1$ and $L_2$ is 40.5 cm, which is approximately equal to the dimension of the display window in the line deflection direction.

Figure 3:
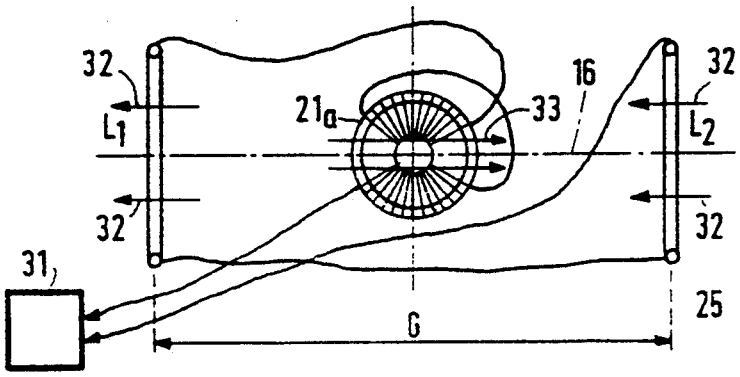
FIG. 3 is a rear view of a display device according to the invention.

The distance D between the longitudinal axis 25 of a coil $L_1$ or $L_2$ and the plane of gravity 23 of the coil 21*a* ranges preferably between 0 and 0.5 times the distance C between the plane 23 and the display window. In this manner, an approximately optimum positive effect of the lateral compensation field generated by the coils $L_1$ and $L_2$ is obtained at the location of a display device arranged next to the display device in question, because the maximum of this compensation field is located at a short distance before the field deflection coil of the further display device. In this example, the distance D is 6.5 cm, i.e. equal to approximately 0.2 times the distance C between the plane of gravity 23 and the plane of the display window. The plane of gravity 23 corresponds to a plane parallel to the plane of the display window and through the center of gravity of the field deflection coil. In FIG. 3, the direction of the lateral compensation field is diagrammatically shown by means of arrows 32. In this example, this field extends approximately transversely to the longitudinal axis 25 of coils $L_1$ and $L_2$. In this example, the coils $L_1$ and $L_2$ have an induction of 650 $\mu$H, a resistance of 0.7 $\Omega$ and comprise approximately 60 windings. In this example, the coils $L_1$ and $L_2$ are electrically connected in series with coil 21*a*. The display device comprises or can be provided with means 31 of supplying current to coil 21.

Figure 4:
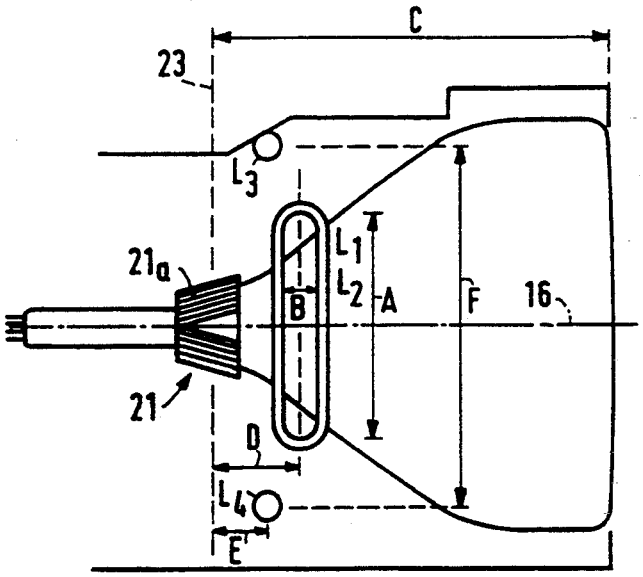
FIG. 4 is a side view of a further embodiment of a display device according to the invention.
Figure 5:
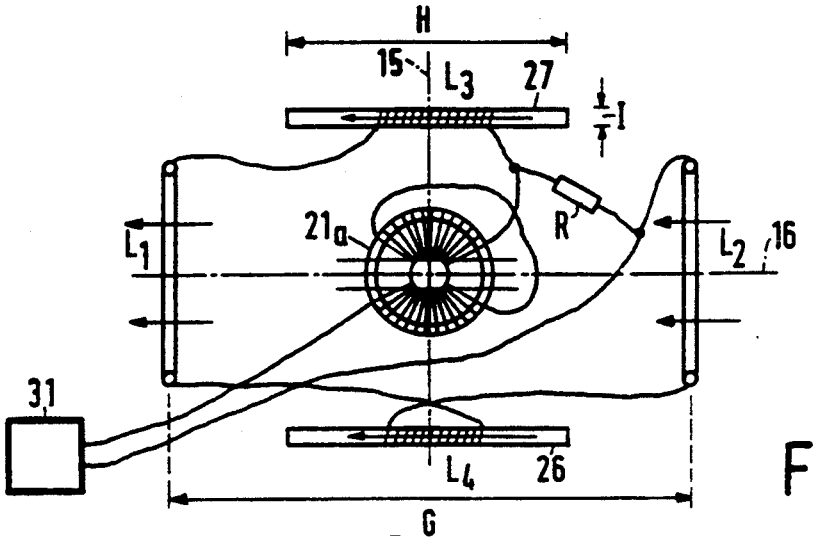
FIG. 5 is a rear view of the display device of FIG. 4.

FIGS. 4 and 5 show a further example of a display device according to the invention. This embodiment of the display device comprises a coil system having two solenoid coils $L_3$ and $L_4$. These solenoid coils are located on either side of the plane of symmetry 16. In operation, these coils $L_3$ and $L_4$ generate a substantially laterally oriented field below and above the display device. By virtue thereof, the negative effect of stray fields on the display device caused by further display devices located below or above said display device can be reduced in a simple and effective manner. The solenoid coils comprise a magnetic core 26, 27. The length of the magnetic cores 26, 27 ranges preferably between 0.4 and 0.8 times the dimension of the display window in the line deflection direction. If the length of the magnetic cores is less than 0.4 times the dimension of the display window in the line deflection direction, the spatial shape of the field generated, in operation, by the solenoid coils is concentrated such that a satisfactory compensation of stray fields of electron beams deflected towards the corners of the display window is difficult to achieve. In this example, the length H of the magnetic cores is 22.5 cm, which is approximately 0.55 times the dimension of the display window in the line deflection direction. Preferably, the solenoid coils are located at a distance of 0.5 F from the plane of symmetry 16, where F is more than 0.5 times the dimension of the display window in the field deflection direction. If the distance is less than 0.5 times the dimension of the display window in the field deflection direction, the deflection field of the electrons 7, 8 and 9 is subject to a relatively large negative influence. Preferably, the distance E between the coils and the plane of gravity 23 ranges between 0 and 0.5 times the distance C. In this manner, a substantially optimum positive effect of the lateral compensation field generated by the coils $L_3$ and $L_4$ at the location of a further display device arranged below or above the display device in question is achieved, because the maximum of this compensation field is located at a short distance before the field deflection coil of the further display device. In this example, the distance E is equal to 2.5 cm and the distance between the plane of gravity and the display window C is equal to 31 cm. The core material used in this example is a material having a permeability $\mu$ of approximately 250. In this example, the core has a section I of 1 cm. The induction is equal to 515 $\mu$H, the resistance is 0.06Ω and the coils comprise 80 windings. If compensation is required only below or above the display device, the solenoid coils can alternatively be used alone, i.e. the display device comprises no coils $L_1$ and $L_2$. Preferably, however, combined use is made of both coil systems.

Preferably, the coils $L_1$ and $L_2$, and if present, the coils $L_3$ and $L_4$ are electrically connected in series with coil 21*a*, as diagrammatically shown in FIG. 5. In operation, the electric currents passing through the coils $L_1$, $L_2$, $L_3$ and $L_4$ have the same frequency as the currents passing through the field deflection coil 21. The display device comprises or can be provided with means 31 of generating, in operation, electric currents which pass through the coils $L_1$, $L_2$, $L_3$ and $L_4$. Preferably, a resistor R is electrically connected in parallel with the serially connected compensation coils, which resistor has a resistance value such that natural resonances are damped to a sufficient degree. Natural resonances may have an adverse effect on the deflection of electron beams. In this example, the resistor R has a resistance value of 470Ω. The coils $L_1$, $L_2$, $L_3$ and $L_4$ are preferably located on or at an envelope 26 of the display device. The mutual interference of two monitors, as described above, which were not provided with coils $L_1$, $L_2$, $L_3$ and $L_4$, was approximately 0.7 mm, which has a very disturbing effect. In the example, the use of the coils $L_1$, $L_2$, $L_3$ and $L_4$ results in a reduction of the mutual interference to approximately 0.05 mm, which is a considerable improvement.

Figures 6A, 6B, 6C, 6D:
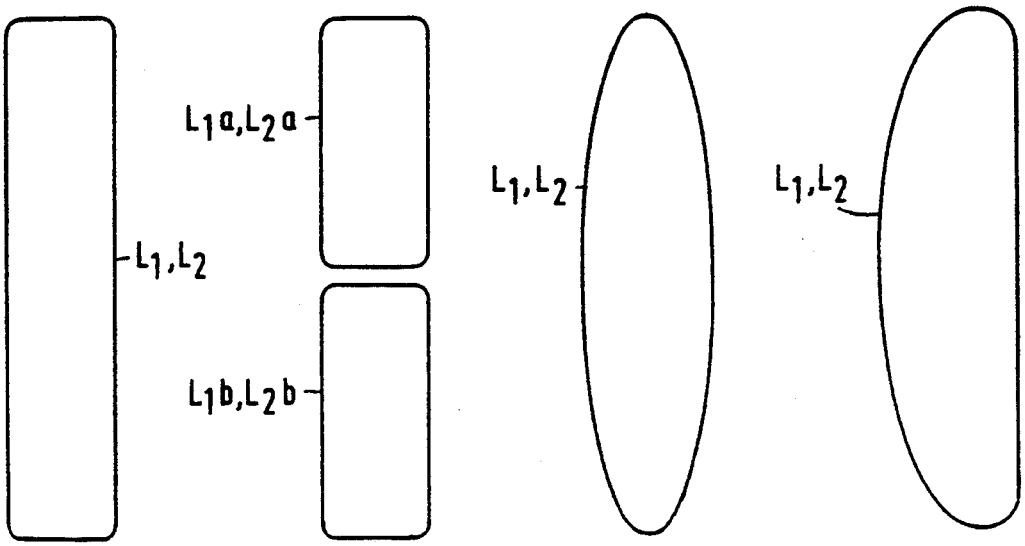
FIGS. 6A–6D are a few examples of coils.

It will be obvious that within the scope of the invention many variations are possible. The example shows a color display device having an in-line electron gun. The invention also applies to, for example, color display devices having a so-called delta electron gun or to monochrome display devices. Within the framework of the invention, electron gun is to be understood to mean a means of generating one or more electron beams. In the example, the coils $L_1$ and $L_2$ have a rectangular shape. Said coils may alternatively have an oval shape. The coils may be composed of two or more subcoils $L_1a$, $L_2a$, $L_1b$, $L_2b$, or may exhibit a flattened D-shape. Some of said possible shapes are shown in FIGS. 6A up to and including 6D. All these shapes are suitable for generating, in operation, a compensating field which extends approximately parallel to the line deflection direction and which, in a direction parallel to the field deflection direction, extends over an area which is much larger (at least 3 times as large) than in a direction transversely to the field deflection direction and transversely to the line deflection direction. In the example, the coils are arranged substantially perpendicularly to the plane of the display window. The coils $L_1$ and $L_2$ may be rotated about the longitudinal axis. In this manner, the influence of the compensating field on the deflection of the electron beams 7, 8 and 9 can be reduced and the spatial shape of the compensating field can be improved at the location of an adjacent display device. The coils $L_1$ and $L_2$ are preferably flat coils, i.e. they extend substantially in one plane, but the invention is not limited thereto.

The example shows a display device having a cathode ray tube with a diagonal of 51 cm. The invention is not limited by the size of the cathode ray tube. In the example, a cathode ray robe is shown in which the line deflection takes place in the horizontal direction and the field deflection takes place in the vertical direction. The invention is not limited thereto, the line deflection direction and the field deflection direction may be exchanged relative to the horizontal axis and the vertical axis.

I claim:

1. A display device comprising a cathode ray tube having an electron gun, a display window and a deflection coil system for deflecting one or more electron beams across the display window in a field deflection direction and a line deflection direction, and comprising compensation means for compensating the stray field of the deflection coil system, characterized in that the compensation means comprise first and second coils disposed on opposite sides of a plane of symmetry of the display window, which plane extends parallel to the field deflection direction, and in that individual windings of each of said coils have an elongated shape such that the dimension of said individual windings in the field deflection direction is more than thrice the dimension of said individual windings in a direction transversely to the field deflection direction and transversely to the line deflection direction.

2. A display device as claimed in claim 1, characterized in that the interspace between the first and second coils is more than approximately 0.7 times the dimension of the display window in the line deflection direction.

3. A display device as claimed in claim 1 or 2, characterized in that the dimension of the individual windings of the first and second coils in the field deflection direction is more than approximately 0.5 times the dimension of the display window in the field deflection direction.

4. A display device as claimed in claim 1 or 2, characterized in that the compensation means comprise third and fourth coils wound around respective longitudinally extending magnetic cores which extend on opposite sides of a plane of symmetry of the display window, which plane extends parallel to the line deflection direction, the longitudinal direction of the magnetic cores being approximately parallel to the line deflection direction.

5. A display device as claimed in claim 4, characterized in that the length of the magnetic cores ranges between 0.4 and 0.8 times the dimension of the display window in the line deflection direction.

6. A display device comprising a cathode ray tube having an electron gun, a display window and a deflection coil system for deflecting one or more electron beams across the display window in a field deflection direction and a line deflection direction, and comprising compensation means for compensating the stray field of the deflection coil system, characterized in that the compensation means comprise two coils wound around respective longitudinally extending magnetic cores which are disposed on opposite sides of a plane of symmetry of the display window, which plane extends parallel to the line deflection direction, the longitudinal direction of the magnetic cores being approximately parallel to the line deflection direction.

7. A display device as claimed in claim 6, characterized in that the length of the magnetic cores ranges between 0.4 and 0.8 times the dimension of the display window in the line deflection direction.

8. A display device as claimed in claim 1, 2, 6 or 7, characterized in that the deflection coil system comprises a toroid-type field deflection coil.

9. A display device as claimed in claim 4 in which the deflection coil system comprises a field deflection coil, characterized in that the first, second, third and fourth coils are electrically connected in series with the field deflection coil.

10. A display device as claimed in claim 9, characterized in that a resistor is electrically connected in parallel with said first, second, third and fourth serially connected coils.

* * * * *